US011519659B2

(12) United States Patent
Song et al.

(10) Patent No.: US 11,519,659 B2
(45) Date of Patent: Dec. 6, 2022

(54) REFRIGERATOR

(71) Applicant: Samsung Electronics Co., Ltd., Suwon-si (KR)

(72) Inventors: Joohee Song, Suwon-si (KR); Byungkwan Yang, Suwon-si (KR); Hyejeong Oh, Suwon-si (KR); Jooyong Lee, Suwon-si (KR); Byungwoo Jeon, Suwon-si (KR); Hyoju Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/988,390

(22) Filed: Aug. 7, 2020

(65) Prior Publication Data

US 2021/0041156 A1 Feb. 11, 2021

(30) Foreign Application Priority Data

Aug. 9, 2019 (KR) ..... 10-2019-0097427

(51) Int. Cl.
*F25D 17/04* (2006.01)
*F25D 11/02* (2006.01)

(52) U.S. Cl.
CPC ..... *F25D 17/045* (2013.01); *F25D 11/02* (2013.01)

(58) Field of Classification Search
CPC .. F25D 17/045; F25D 11/02; F25D 2317/067; F25D 2317/0665; F25D 2317/0672; F25D 2500/02; F25D 17/06; F25D 17/08; F25D 23/023
See application file for complete search history.

(56) References Cited

U.S. PATENT DOCUMENTS

2004/0163401 A1* 8/2004 Alahyari ..... A47F 3/0447 62/256
2006/0070395 A1* 4/2006 Lee ..... F25D 17/062 62/419
2018/0172336 A1* 6/2018 Bae ..... F25D 17/062

FOREIGN PATENT DOCUMENTS

JP 2508035 Y2 8/1996
JP 2002098465 A * 4/2002
JP 6134610 B2 5/2017
KR 1997-075770 * 4/1997
KR 10-1997-0075774 A 12/1997
KR 10-0159712 B1 1/1999
(Continued)

OTHER PUBLICATIONS

International Search Report of the International Searching Authority in connection with International Application No. PCT/KR2020/009606 dated Nov. 3, 2020, 4 pages.

*Primary Examiner* — Frantz F Jules
*Assistant Examiner* — Martha Tadesse

(57) ABSTRACT

Disclosed herein is a refrigerator. The refrigerator includes a body, a storage compartment disposed inside the body, an evaporator configured to generate cold air and disposed behind the storage compartment, and a duct configured to supply the cold air generated by the evaporator to the storage compartment. The duct includes a first discharge hole through which air flowing in the duct is discharged, a plurality of second discharge holes through which air is discharged at a speed lower than a speed of the air discharged through the first discharge hole, and a damper configured to selectively regulate a flow of air to guide the air in the duct to the first discharge hole or the plurality of second discharge holes.

20 Claims, 18 Drawing Sheets

(56) References Cited

FOREIGN PATENT DOCUMENTS

| | | | |
|---|---|---|---|
| KR | 20-1999-0020183 | U | 6/1999 |
| KR | 10-0493691 | B1 | 6/2005 |
| KR | 10-2018-0069638 | A | 6/2018 |

* cited by examiner

REFRIGERATOR

CROSS-REFERENCE TO RELATED APPLICATION

This application is based on and claims priority under 35 U.S.C. § 119 to Korean Patent Application No. 10-2019-0097427, filed on Aug. 9, 2019, in the Korean Intellectual Property Office, the disclosure of which is incorporated by reference herein in its entirety

BACKGROUND

1. Field

The disclosure relates to a refrigerator, and more particularly to a duct of a refrigerator.

2. Description of Related Art

A refrigerator is a household appliance that keeps food fresh by having a housing provided with a storage compartment, a cold air supply device configured to supply cold air to the storage compartment, and a door configured to open and close the storage compartment.

In the case of a refrigerator, a cold air supply device may be provided in a direct cooling type or an indirect cooling type to cool the storage compartment.

In the case of the direct cooling type, a cooler is disposed adjacent to the storage compartment to lower a temperature of the inside of the storage compartment through natural convection, and in the case of the indirect cooling type, cold air is supplied to the inside of the storage compartment so as to lower a temperature of the inside the storage compartment.

In particular, the indirect cooling type refrigerator is popular for household use. As for the indirect cooling type refrigerator, a cooling rate is high inside the storage compartment, but it has difficulty in which some amount of moisture of food is removed by cold air flowing in the storage compartment.

SUMMARY

Therefore, it is an aspect of the disclosure to provide a refrigerator, which is in a type that flows cold air to a storage compartment, capable of efficiently cooling an inside of a storage compartment by changing a speed of air discharged to the storage compartment through a plurality of flow paths as needed.

Additional aspects of the disclosure will be set forth in part in the description which follows and, in part, will be evident from the description, or may be learned by practice of the disclosure.

In accordance with an aspect of the disclosure, a refrigerator includes a body, a storage compartment disposed inside the body, an evaporator configured to generate cold air and disposed behind the storage compartment, and a duct configured to supply the cold air generated by the evaporator to the storage compartment, and the duct includes a first discharge hole through which air flowing in the duct is discharged, a plurality of second discharge holes through which air is discharged at a speed lower than a speed of the air discharged through the first discharge hole, and a damper configured to selectively regulate a flow of air to guide the air in the duct to the first discharge hole or the plurality of second discharge holes.

A discharge area of each of the plurality of second discharge holes may be less than a discharge area of the first discharge hole.

The duct may include an opening configured to allow air to flow into the plurality of second discharge holes and a discharge plate in which the plurality of second discharge holes is formed, and the discharge plate may be configured to cover the opening.

An area of the opening may be greater than the discharge area of the first discharge hole.

The duct may include a main flow path through which air flowing into the duct flows, a first flow path through which air flows from the main flow path to the first discharge hole, and a second flow path through which air flows from the main flow path to the plurality of second discharge holes, and an inflow area of an inflow portion of the second flow path may be greater than an inflow area of an inflow portion of the first flow path.

The damper may be disposed in the inflow portion of the second flow path so as to open and close the inflow portion of the second flow path.

The duct may allow an amount of air flowing into the second flow path to be greater than an amount of air flowing into the first flow path when the damper opens the inflow portion of the second flow path.

The duct may allow air to flow into the first flow path when the damper closes the inflow portion of the second flow path.

The first discharge hole may be arranged on a rear surface of the storage compartment and the plurality of second discharge holes may be arranged on an upper surface of the storage compartment.

The duct may include a first wall configured to allow the main flow path and the first flow path to be separated from each other, and a second wall configured to form the first flow path together with the first wall, and the inflow portion of the first flow path may be formed between one end of the first wall and one end of the second wall.

The one end of the first wall and the one end of the second wall may be provided to allow the inflow portion of the first flow path to be arranged on the outside of an air flow direction on the main flow path.

The first discharge hole and the plurality of second discharge holes may be arranged on the rear surface of the storage compartment.

The damper may be configured to open and close the first discharge hole.

The first discharge hole may be disposed above the plurality of second discharge holes.

A cross-sectional area of the plurality of second discharge holes may be approximately 0.05 mm2 or more and 5 mm2 or less.

In accordance with another aspect of the disclosure, a refrigerator includes a body, a storage compartment disposed inside the body, an evaporator configured to generate cold air and disposed behind the storage compartment, and a duct configured to supply the cold air generated by the evaporator to the storage compartment, and the duct includes a first discharge hole through which air flowing in the duct is discharged, a plurality of second discharge holes, a main flow path through which air flowing into the duct flows, a first flow path through which air flows from the main flow path to the first discharge hole, a second flow path through which air flows from the main flow path to the plurality of second discharge holes, and a damper configured to guide the air flowing on the main flow path to the first flow path or the second flow path, and an inflow area of an inflow portion of the second flow path is greater than an inflow area of an inflow portion of the first flow path.

The first discharge hole may be arranged on a rear surface of the storage compartment and the plurality of second discharge holes may be arranged on an upper surface of the storage compartment.

The duct may include a first wall configured to allow the main flow path and the first flow path to be separated from each other and a second wall configured to form the first flow path together with the first wall, and the inflow portion of the first flow path may be formed between one end of the first wall and one end of the second wall.

The duct may include a discharge plate in which the plurality of second discharge holes is formed, and one end of the second flow path may be connected to the main flow path, and the other end of the second flow path may include an opening provided to allow air to flow into the plurality of second discharge holes, and the discharge plate may be arranged on the upper surface of the storage compartment so as to cover the opening.

In accordance with another aspect of the disclosure, a refrigerator includes a body, a storage compartment disposed inside the body, an evaporator configured to generate cold air and disposed behind the storage compartment, and a duct configured to supply the cold air generated by the evaporator to the storage compartment, and the duct includes a first discharge hole through which air flowing in the duct is discharged, a plurality of second discharge holes having a cross-sectional area of approximately 0.05 mm2 or more and 5 mm2 or less, and a damper configured to selectively regulate a flow of air to guide the air in the duct to the first discharge hole or the plurality of second discharge holes.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
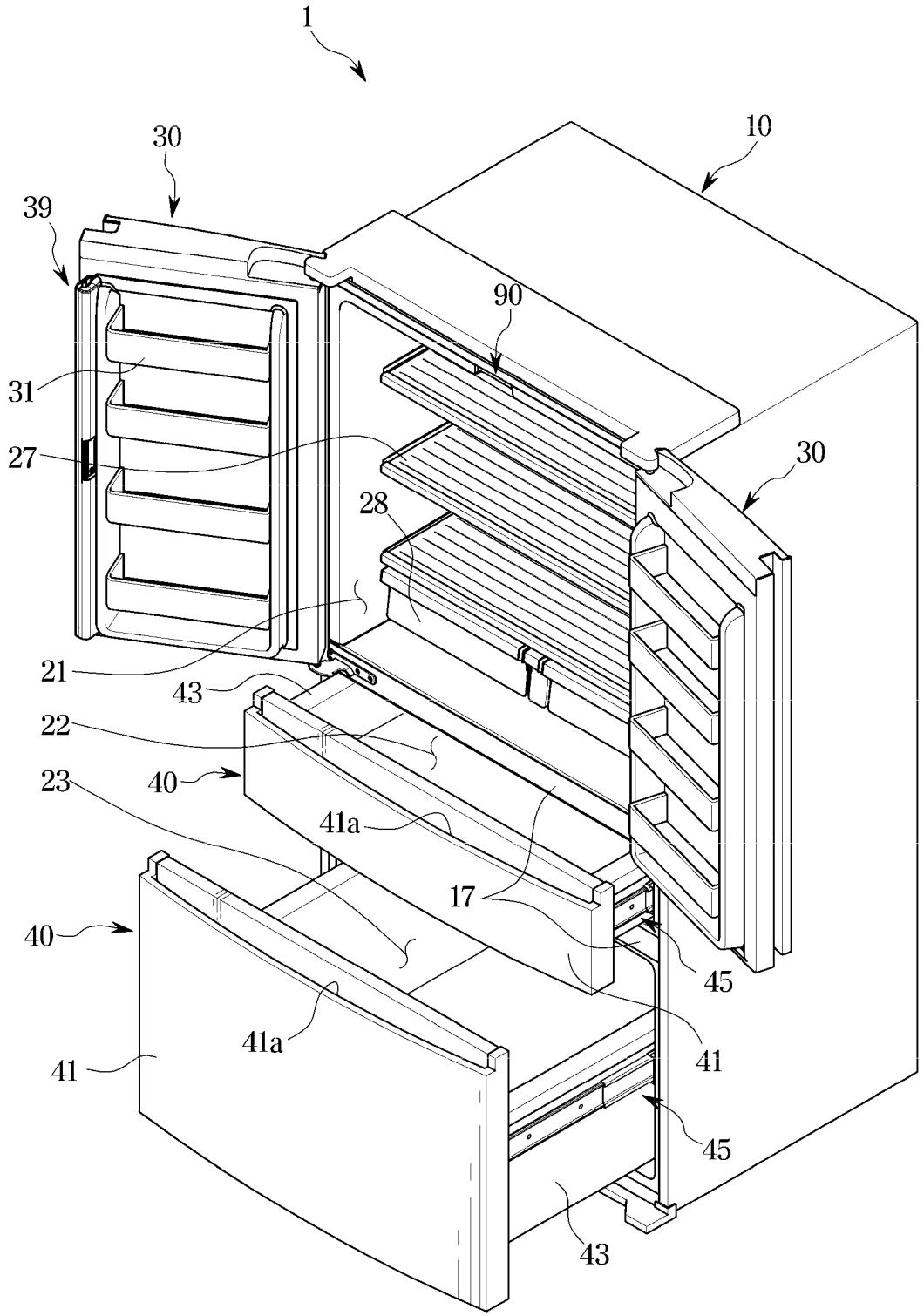
FIG. 1 illustrates a view of a refrigerator according to an embodiment of the disclosure.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "upper portion", "lower portion", "upper end", "lower end" and the like may be defined by the drawings, but the shape and the location of the component is not limited by the term.

The disclosure will be described more fully hereinafter with reference to the accompanying drawings.

Figure 2:
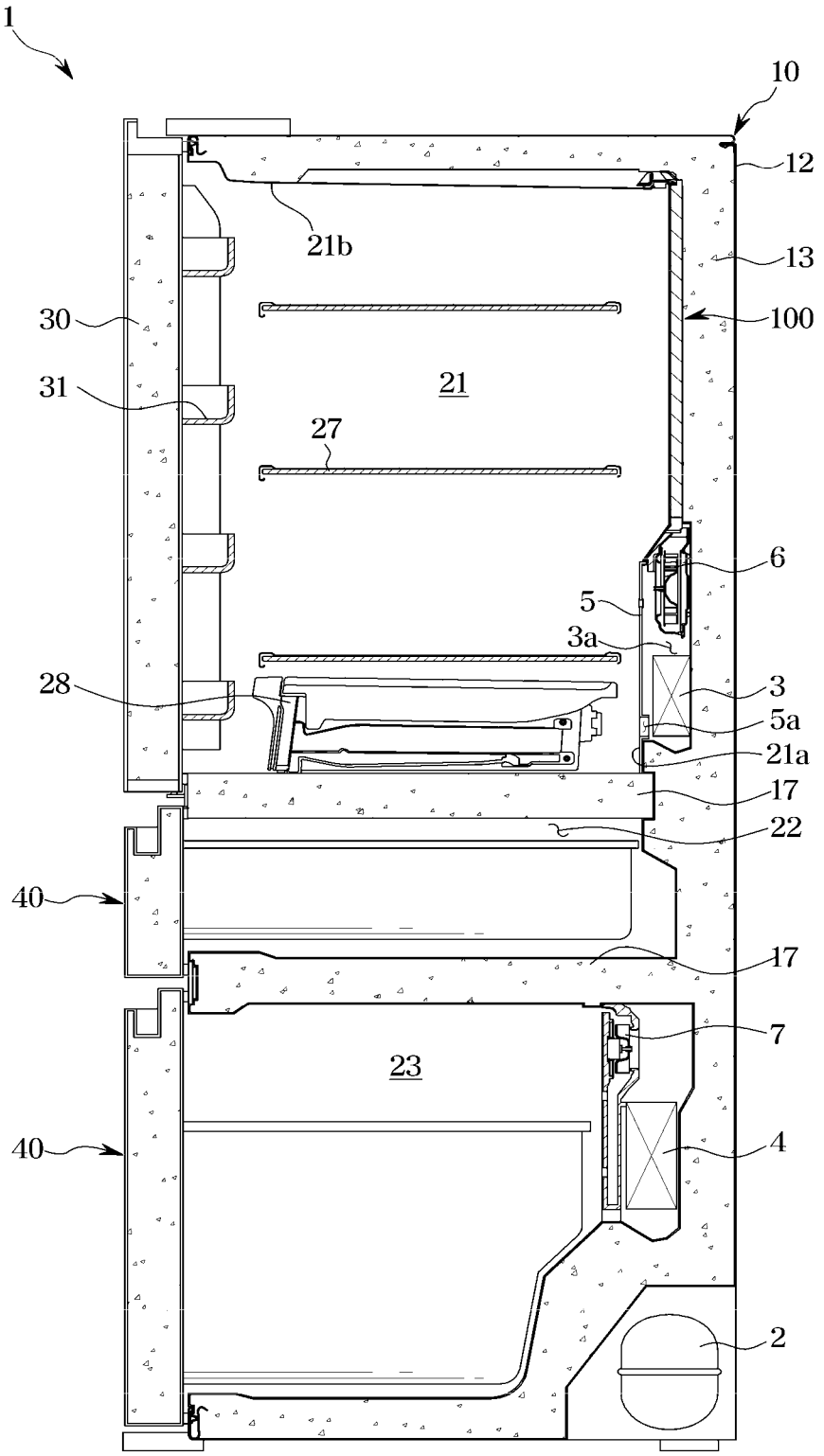
FIG. 2 illustrates a schematic side cross-sectional view of the refrigerator of FIG. 1.

FIG. 1 is a view of a refrigerator 1 according to an embodiment of the disclosure. FIG. 2 is a schematic side cross-sectional view of the refrigerator 1 of FIG. 1.

Referring to FIGS. 1 and 2, the refrigerator 1 may include a housing 10 including storage compartments 21, 22, and 23, doors 30 and 40 configured to open and close the storage compartments 21, 22, and 23, and a cold air supply device configured to supply cold air to the storage compartments 21, 22, and 23.

The housing 10 may include an inner case 11 configured to form the storage compartments 21, 22, and 23, an outer case 12 coupled to the outside of the inner case 11, and an insulating material 13 provided between the inner case 11 and the outer case 12. The inner case 11 may be formed by injection molding of a plastic material, and the outer case 12 may be formed of a metallic material. Urethane foam insulation may be used as the insulation material 13, and a vacuum insulation panel may be used, as needed. The housing 10 may include an intermediate wall 17 configured to divide the storage compartments 21, 22, and 23 into an upper portion and a lower portion.

The storage compartments 21, 22, and 23 may be used as a refrigerating compartment that is maintained at about 0 to 5° C. for storing foods at a refrigerating state and a freezing compartment maintained at about −30 to 0° C. for storing foods at a freezing state.

The storage compartments 21, 22, and 23 are provided with an open front surface to allow foods to be inserted into or taken out therefrom, and the opened front surface of the storage compartments 21, 22, 23 may be opened and closed by the doors 30, 40. A shelf 27, on which food is placed, and a storage container 28, configured to store food may be provided in the storage compartments 21, 22 and 23.

The first door 30 may be configured to open and close the first storage compartment 21. The first door 30 may be coupled to the housing 10 so as to be rotatable in a left and right direction. A door guard 31 configured to store food may be provided on a rear surface of the first door 30.

A rotating bar 39 may be rotatably mounted on one of the first doors 30, and the rotating bar 39 is configured to close a gap between the first doors 30 while the first doors 30 close the storage compartment 21.

The rotating bar 39 may be provided in a bar shape elongated along a height direction of the first door 30 and rotated by a guide 90 provided in the housing 10.

The second door 40 may be slidable to be inserted into the inside of the second storage compartment 22 and the third storage compartment 23 or to be taken out of the second storage compartment 22 and the third storage compartment 23. The second door 40 may include a door portion 41 configured to cover the open front surfaces of the second storage compartment 22 and the third storage compartment 23 and a basket 43 coupled to the rear surface of the door portion 41. The basket 43 may be slidably supported by a rail 45. The door portion 41 may be provided with a handle 41*a*.

The cold air supply device may generate cold air using latent heat of evaporation of the refrigerant through a cooling cycle. The cold air supply device may include a compressor 2, a condenser, an expansion device, evaporators 3 and 4, and blower fans 6 and 7.

The first evaporator 3 may be disposed behind the first storage compartment 21 to generate cold air. The first evaporator 3 may be accommodated in a cooling chamber 3*a* formed by an evaporator cover 5. The evaporator cover 5 may include a suction port 5*a*, and air may be sucked from the first storage compartment 21 to the cooling chamber 3*a* through the suction port 5*a*.

A first blower fan 6 may be provided in the cooling chamber 3*a* to move air. The cold air formed in the cooling chamber 3*a* may flow into a duct 100 through the first blower fan 6.

When the first blower fan 6 is operated, air may be sucked from the first storage compartment 21 to the cooling chamber 3*a* through the suction port 5*a*, and the sucked air may be cooled through the evaporator 3 and then discharged to the inside of the first storage compartment 21 through the duct 100.

Hereinafter the duct 100 will be described in detail.

Figure 3:
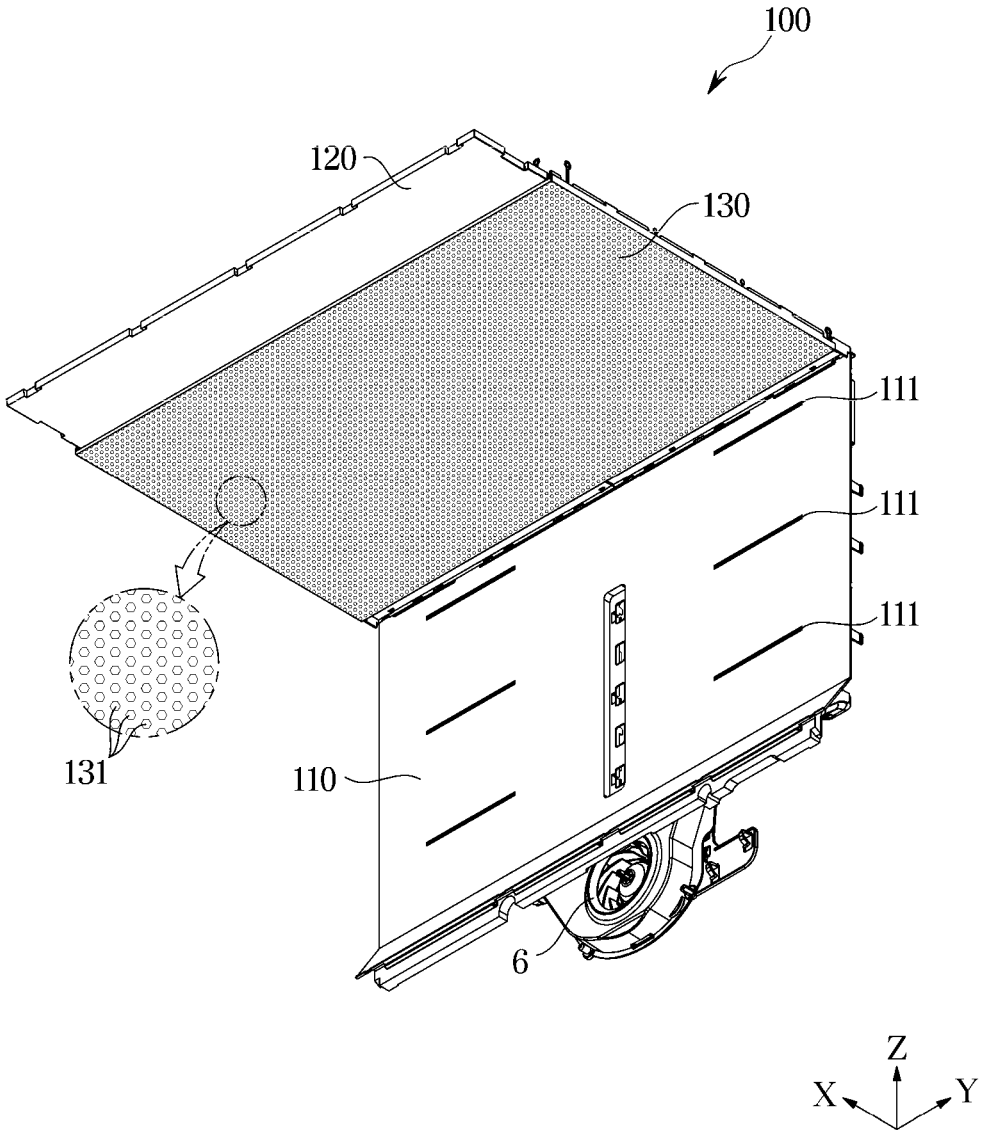
FIG. 3 illustrates a front perspective view of a duct of the refrigerator according to an embodiment of the disclosure.
Figure 4:
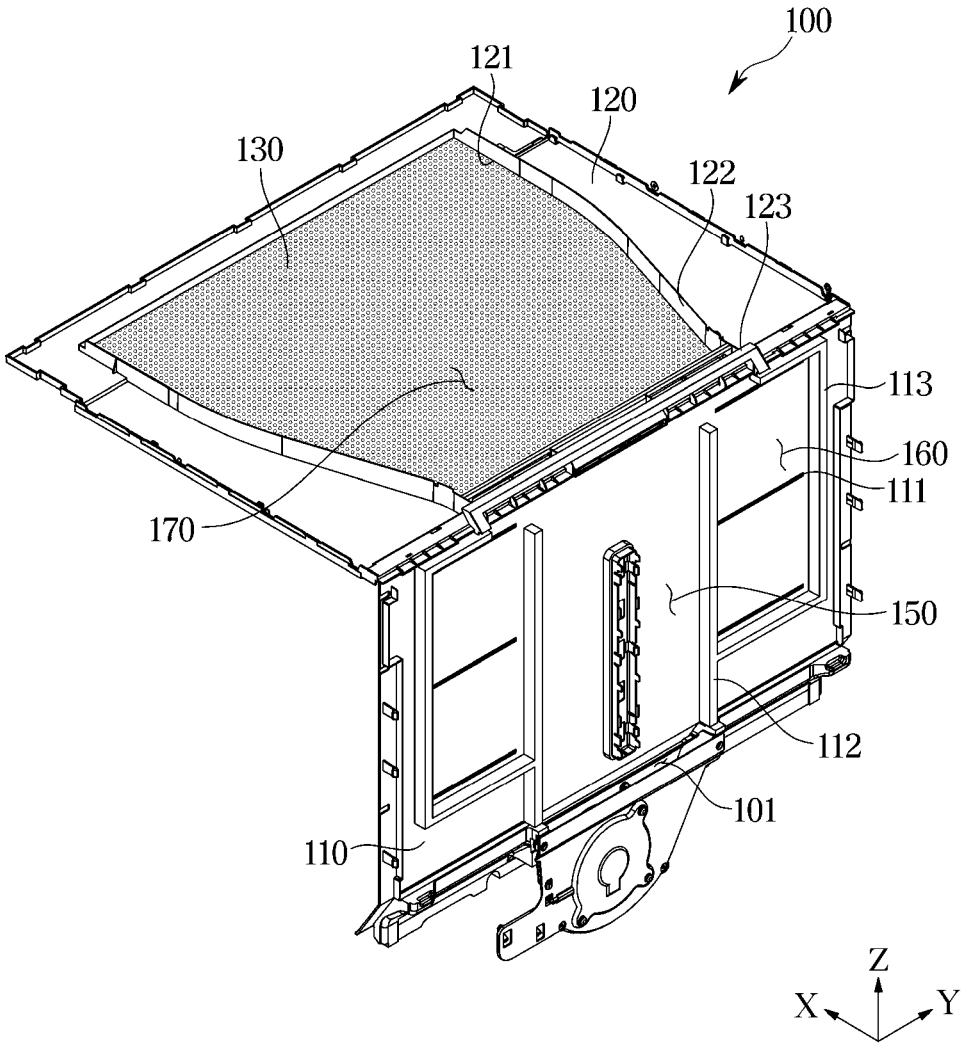
FIG. 4 illustrates a rear perspective view of the duct of FIG. 3.
Figure 5:
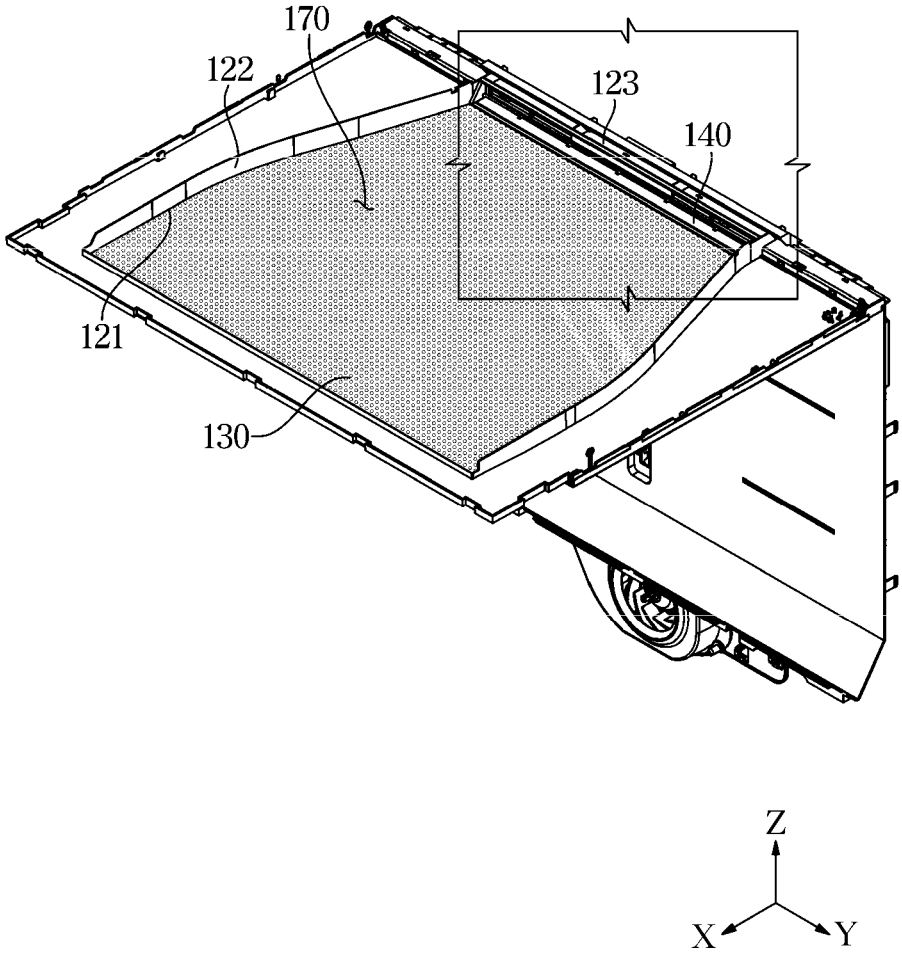
FIG. 5 illustrates a top perspective view of the duct of FIG. 3.

FIG. 3 is a front perspective view of a duct of the refrigerator according to an embodiment of the disclosure, FIG. 4 is a rear perspective view of the duct of FIG. 3, and FIG. 5 is a top perspective view of the duct of FIG. 3.

Hereinafter for convenience of description, the first storage compartment 21 is referred to as a storage compartment 21, and the first evaporator 3 and the first blower fan 6 are respectively referred to as an evaporator 3 and a blower fan 6, respectively.

In the case of a conventional refrigerator including a duct, the inside of the storage compartment is cooled by cold air discharged from a discharge port provided in the duct. Because the storage compartment is cooled by circulating the cold air as described above, cold air may be evenly transferred to the inside of the storage compartment, and the inside of the storage compartment may be rapidly cooled.

However, as the circulating cold air comes into contact with the food stored in the storage compartment, moisture in the food is removed, which may lead to deterioration in storage quality of food. Particularly, as the speed of the discharged air is increased higher, the amount of moisture removed from the food may become greater. Further, because the number of the discharge port provided in the duct is limited, some spaces may be inefficiently cooled.

Accordingly, in order to relieve the above mentioned difficulty, the refrigerator 1 according to an embodiment of the disclosure may include the duct 100 configured to rapidly cool the storage compartment while additionally preserving the moisture of food stored in the storage compartment as much as possible.

Particularly, the duct 100 may include a first discharge port 111 through which cold air at a high speed is discharged to increase a cooling speed of the storage compartment, and a plurality of second discharge ports 131 through which cold air at a low speed is discharged to increase the storage quality of the food.

The duct 100 may be divided into a first flow path 160 through which the air discharged through the first discharge port 111 flows and a second flow path 170 through which the air flows through the plurality of second discharge ports 131. Therefore, as for the duct 100, air in the duct 100 may be discharged to the first discharge port 111 or the plurality of second discharge ports 131 along the first flow path 160 or the second flow path 170, respectively. Alternatively, the air in the duct 100 may be simultaneously discharged to the first discharge port 111 and the plurality of second discharge ports 131.

By including a damper 140, the duct 100 may guide the air in the duct 100 to flow to the first flow path 160 or the second flow path 170.

That is, when a temperature of the storage compartment 21 is increased and rapid cooling is desired, a controller (not shown) may control the damper 140 to allow the air in the duct 100 to be discharged to the storage compartment 21 through the first discharge port 111.

In addition, when the temperature of the storage compartment 21 reaches a predetermined temperature, the controller (not shown) may control the damper 140 to allow the air in the duct 100 to be discharged to the storage compartment 21 through the plurality of second discharge ports 131.

That is, the duct 100 of the refrigerator 1 according to an embodiment of the disclosure may be provided with two or more flow paths 160 and 170 and configured to change a discharge region, to which cold air is discharged, depending on the flow path 160 and 170. In one discharge region where the first discharge port 111 is provided, cold air may be rapidly discharged, and in other discharge region where the plurality of second discharge ports 131 is provided, cold air may be discharged slower than the cold air discharged from the first discharge port 111.

Accordingly, it is possible to quickly lower the temperature of the inside of the storage compartment 21, and when the temperature of the inside of the storage compartment 21 reaches a predetermined temperature, it is possible to maximally prevent the moisture of the food from being removed by lowering the discharge speed of the air.

Hereinafter the configuration of the duct 100 will be described in detail.

The duct 100 may include a first surface 110 configured to form at least a portion of a rear surface 21*a* of the storage compartment 21 and a second surface 120 configured to form at least a portion of an upper surface 21*b* of the storage compartment 21 (refer to FIG. 2).

Although not shown in the drawing, the duct 100 may include a cover member (not shown) configured to cover the first surface 110 from the rear side and configured to cover the second surface 120 from the front side. However, the disclosure is not limited thereto, and the first surface 110 and the second surface 120 may be covered by the inner case 11 of the refrigerator 1.

The duct 100 may form a flow path, through which air may flow, by the first surface 110 and the second surface 120, and the cover member (not shown) configured to cover the first surface 110 and the second surface 120.

The first discharge port 111 may be arranged on the first surface 110. The first discharge port 111 may be provided in plural. Because the first discharge port 111 is disposed on the first surface 110, air discharged through the first discharge port 111 may be discharged from the rear surface 21*a* of the storage compartment 21 to the front of the storage compartment 21.

The second surface 120 may include an opening 121 through which air is discharged.

The duct 100 may include a discharge plate 130, in which a plurality of second discharge holes 131 is formed, and configured to cover the opening 121 of the second surface 120.

The air flowing in the duct 100 may flow to the plurality of second discharge ports 131 through the opening 121.

The discharge plate 130 may be arranged to correspond to the opening 121 in an up and down direction and may have an area equal to or greater than a discharge area of the opening 121.

Because the second surface 120 is disposed on the upper surface 21*b* of the storage compartment 21 and the discharge plate 130 is also disposed on the upper side of the storage compartment 21, the air discharged through the plurality of second discharge holes 131 may be discharged from the upper surface 21*b* of the storage compartment 21 to the lower side of the storage compartment 21.

According to an embodiment of the disclosure, the discharge plate 130 and the second surface 120 are provided in separate configurations, but are not limited thereto. Therefore, the discharge plate 130 and the second surface 120 may be integrally formed with each other.

A discharge area of each of the plurality of second discharge holes 131 may be less than a discharge area of the first discharge hole 111.

Particularly, there is no limitation in the discharge area of the plurality of second discharge holes 131. However, it is appropriate that the discharge area is approximately 0.05 $mm^2$ or more and 5 $mm^2$ or less.

When the discharge area of each of the plurality of second discharge holes 131 is 0.05 $mm^2$ or less, the air may not smoothly flow to the plurality of second discharge holes 131 and thus it is appropriate that the area is 0.05 $mm^2$ or more.

Alternatively, the discharge area of each of the plurality of second discharge holes 131 may be approximately 5 $mm^2$ or less. Further, each of the plurality of discharge holes may have the same area, or may have different area.

As described above, because the discharge area of the plurality of second discharge holes 131 are relatively small, the speed of air, which is discharged through the plurality of second discharge holes 131, in the duct 100, may be less than the speed of the air discharged through the first discharge port 111.

Therefore, when the air in the duct 100 is discharged through the first discharge hole 111, the speed of the discharge air flow may be high and thus it is possible to rapidly lower the temperature of the inside of the storage compartment 21.

In contrast, when the air in the duct 100 is discharged through the plurality of second discharge holes 131, the speed of the discharge air flow may be low and thus it is possible to maintain a cooling state of the storage compartment 21 while maximally preserving the moisture of the food stored in the storage compartment 21.

The total discharge area of the plurality of second discharge holes 131 may be greater than the total discharge area of the first discharge holes 111. That is, the discharge area of each of the plurality of second discharge holes 131 may be less than the discharge area of the first discharge hole 111, but the sum of the discharge area of the plurality of second discharge holes 131 may be greater than the discharge area of the first discharge hole 111.

An area of the opening 121 of the second surface 120 may also be greater than the discharge area of the first discharge hole 111.

The duct 100 may include an inlet 101 provided to allow air blown from the blower fan 6 to flow into the duct 100. The inlet 101 may be disposed at the lower end of the first surface 110.

The duct 100 may include a main flow path 150 on which air, which flows into the duct 100 through the inlet 101, flows, the first flow path 160 branched from the main flow path 150 and configured to allow air to flow to the first discharge port 111, and the second flow path 170 branched from the main flow path 150 and configured to allow air to flow to the plurality of second discharge ports 131.

The main flow path 150 and the first flow path 160 may be provided on the rear side of the first surface 110. The second flow path 170 may be provided in the upper side of the second surface 120.

The air flowing into the duct 100 through the inlet 101 may flow into the main flow path 150 and flow into the first flow path 160 or the second flow path 170, and then be discharged to the storage compartment 21 through the first discharge port 111 or the plurality of second discharge ports 131.

The duct 100 may include a first wall 112 configured to form the main flow path 150 and configured to allow the main flow path 150 and the first flow path 160 to be separated from each other.

The duct 100 may include a second wall 113 configured to form the first flow path 160 together with the first wall 112.

The main flow path 150 may be formed in a space surrounded by the first wall 112. The first flow path 160 may be formed in a space surrounded by the first wall 112 and the second wall 113.

The first wall 112 and the second wall 113 may be disposed on the first surface 110. Particularly, the first wall 112 and the second wall 113 may be extended downward from the first surface 110.

The first wall 112 may be extended to have a length in an approximately up and down direction. The first wall 112 may be extended vertically in the up and down direction, but is not limited thereto. Therefore, the first wall 112 may be inclined with respect to the up and down direction or may be extended with a curve.

The duct 100 may include a third wall 122 configured to form the second flow path 170.

The third wall 122 may be disposed on the second surface 120. Particularly, the third wall 122 may be extended upward from the second surface 120.

The second flow path 170 may be formed in a space surrounded by the third wall 122.

The opening 121 may be formed along a lower end of the third wall 122. The third wall 122 may be provided in such a way that a width of the opening 121 in the left and right direction is increased as the third wall 122 becomes near to the front end.

Figure 7:
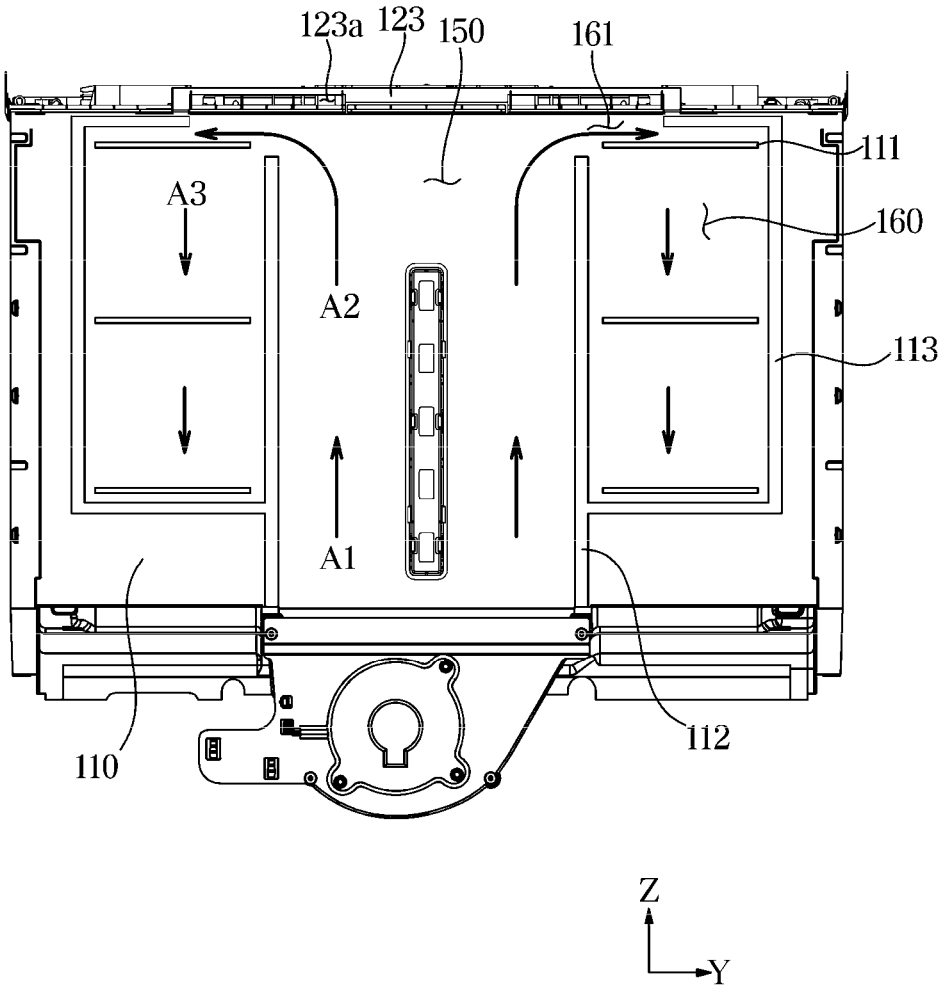
FIG. 7 illustrates a view of a rear surface of the duct of FIG. 6.

The first flow path 160 may include a first flow path inflow portion 161 configured to allow air flowing in the main flow path 150 to flow into the first flow path 160 (refer to FIG. 7).

The first flow path inflow portion 161 may be formed in an open space between one end of the first wall 112 and one end of the second wall 113.

The second flow path 170 may include a second flow path inflow portion 123 configured to allow air flowing in the main flow path 150 to flow into the second flow path 170.

The second flow path inflow portion 123 may be formed in an open space between opposite ends of the third wall 122.

The second flow path inflow portion 123 may further include a second flow path inflow portion port 123*a* through which air flows into the second flow path 170. However, the disclosure is not limited thereto, and the second flow path inflow portion 123 itself may be formed as a space in which air flows through the second flow path 170, and thus the second flow path inflow portion 123 may be provided without the second flow path inflow portion port 123*a*.

As mentioned above, the duct 100 may include the damper 140 configured to selectively regulate the flow of air in the duct 100 to guide the air, which flows in the duct 100, to the first discharge hole 111 or the plurality of second discharge holes 131.

The damper 140 may be disposed in the second flow path inflow portion 123. Accordingly, the damper 140 may regulate the flow of the air in the duct 100 into the second flow path 170 by selectively opening and closing the second flow path inflow portion 123.

Figure 6:
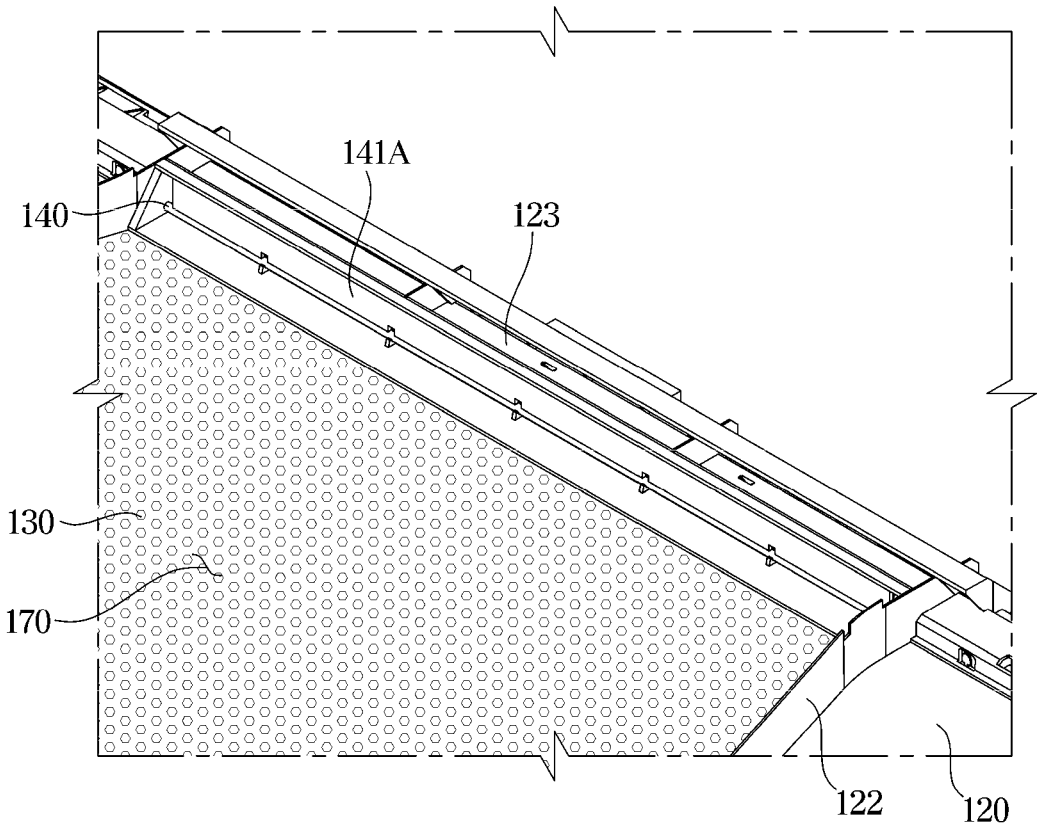
FIG. 6 illustrates an enlarged view illustrating a state in which a damper of the duct of FIG. 5 is in a closed state.

The damper 140 may include a stopper 141 (refer to FIG. 6). The stopper 141 may be rotatable so as to close or open the second flow path inflow portion 123.

When the damper 140 opens the second flow path inflow portion 123, air flowing on the main flow path 150 may flow into the second flow path 170, and some of the air may flow into the first flow path 160.

When the damper 140 closes the second flow path inflow portion 123, air flowing on the main flow path 150 may flow into the first flow path 160.

That is, the damper 140 may selectively prevent air from flowing into the second flow path 170. Hereinafter the flow of air in the duct 100 according to the opening and closing of the damper 140 will be described in detail.

Figure 8:
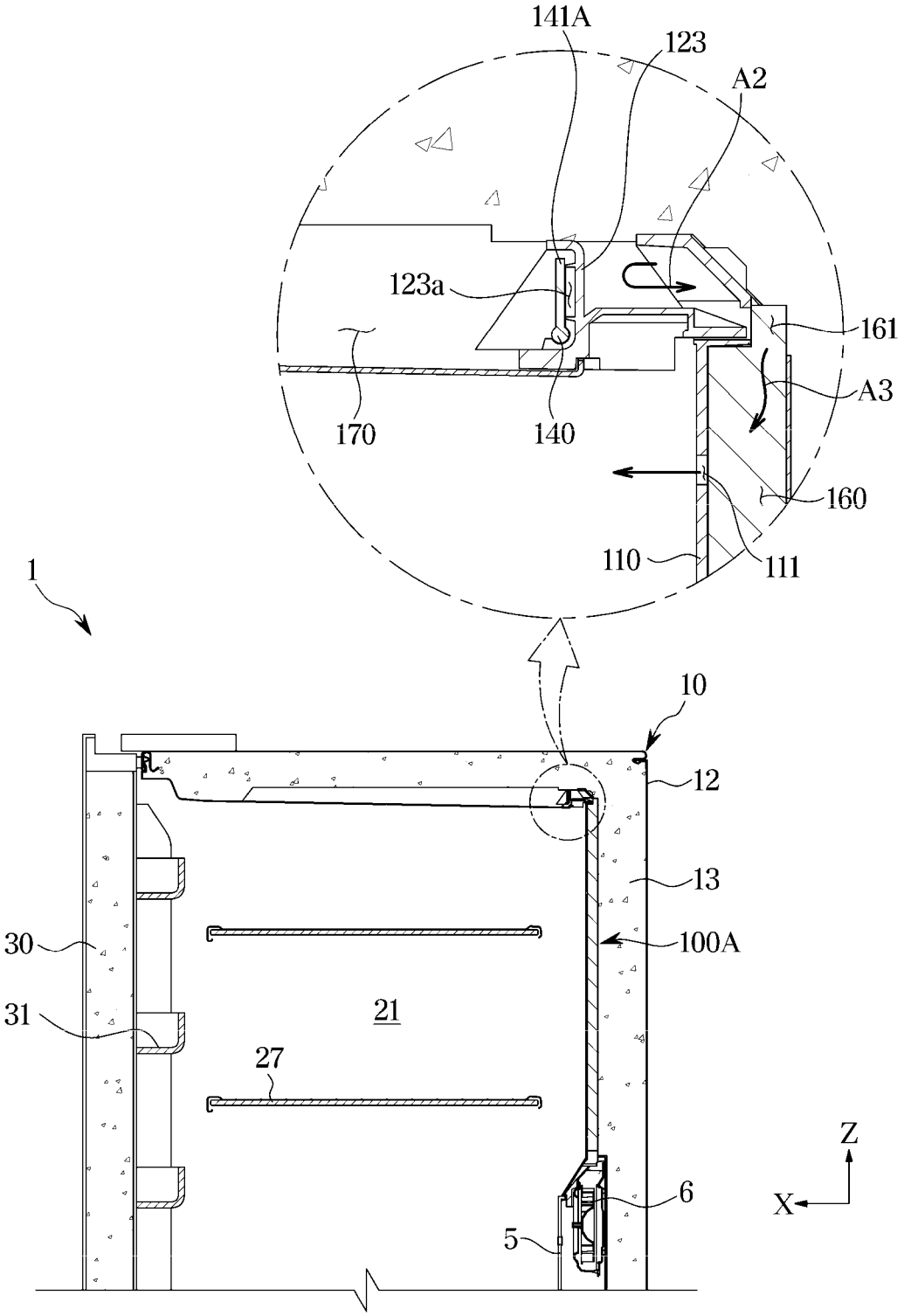
FIG. 8 illustrates a schematic side cross-sectional view of the refrigerator in which the damper of FIG. 6 is in a closed state.
Figure 9:
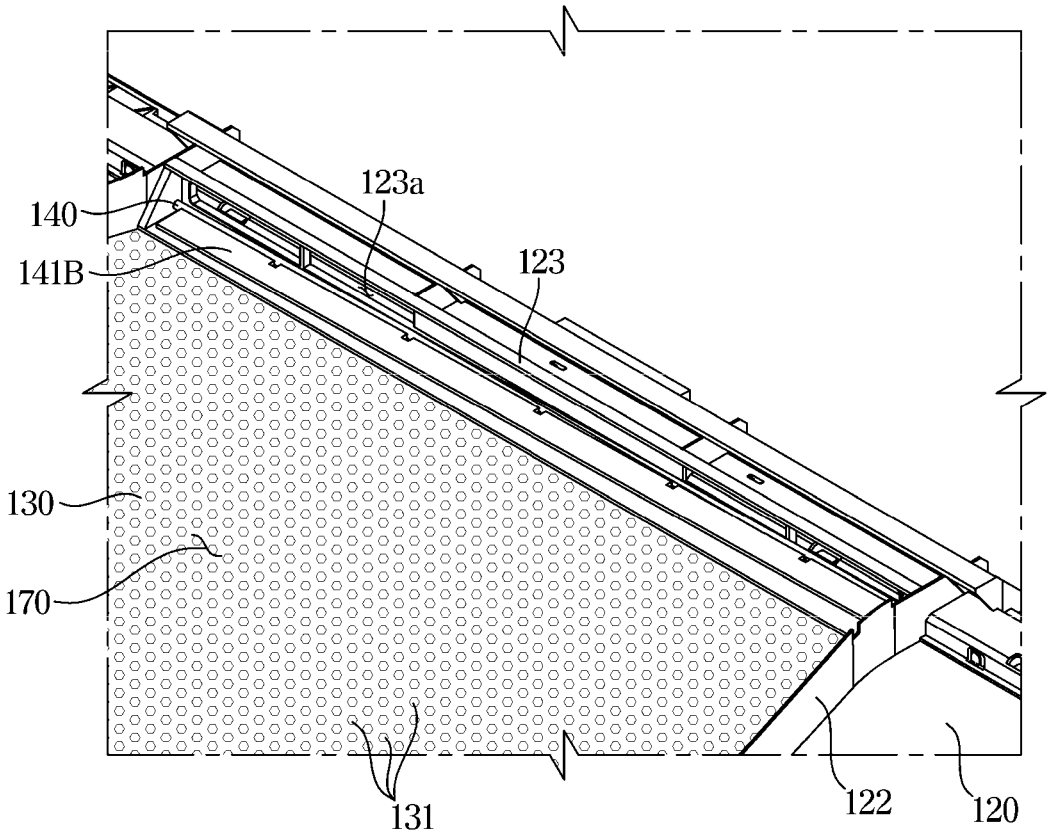
FIG. 9 illustrates an enlarged view in which the damper is in an open state in the duct of FIG. 5.
Figure 10:
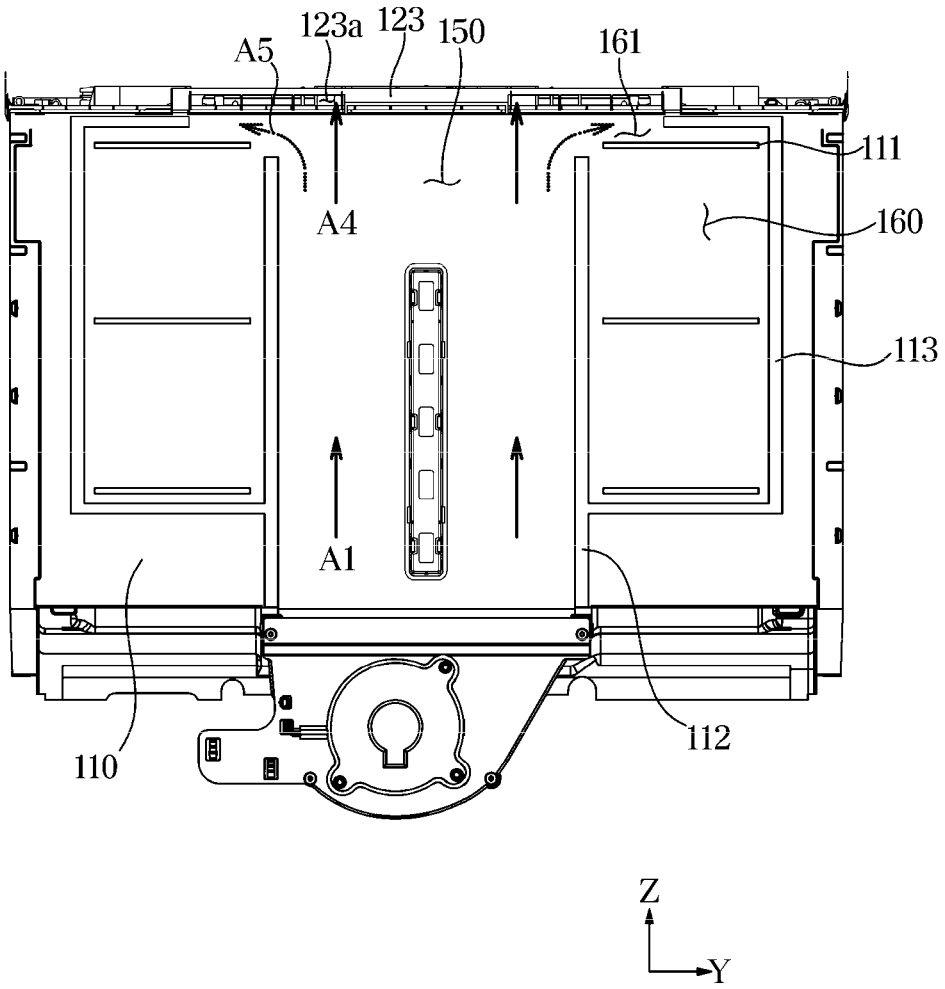
FIG. 10 illustrates a view of a rear surface of the duct of FIG. 9.
Figure 11:
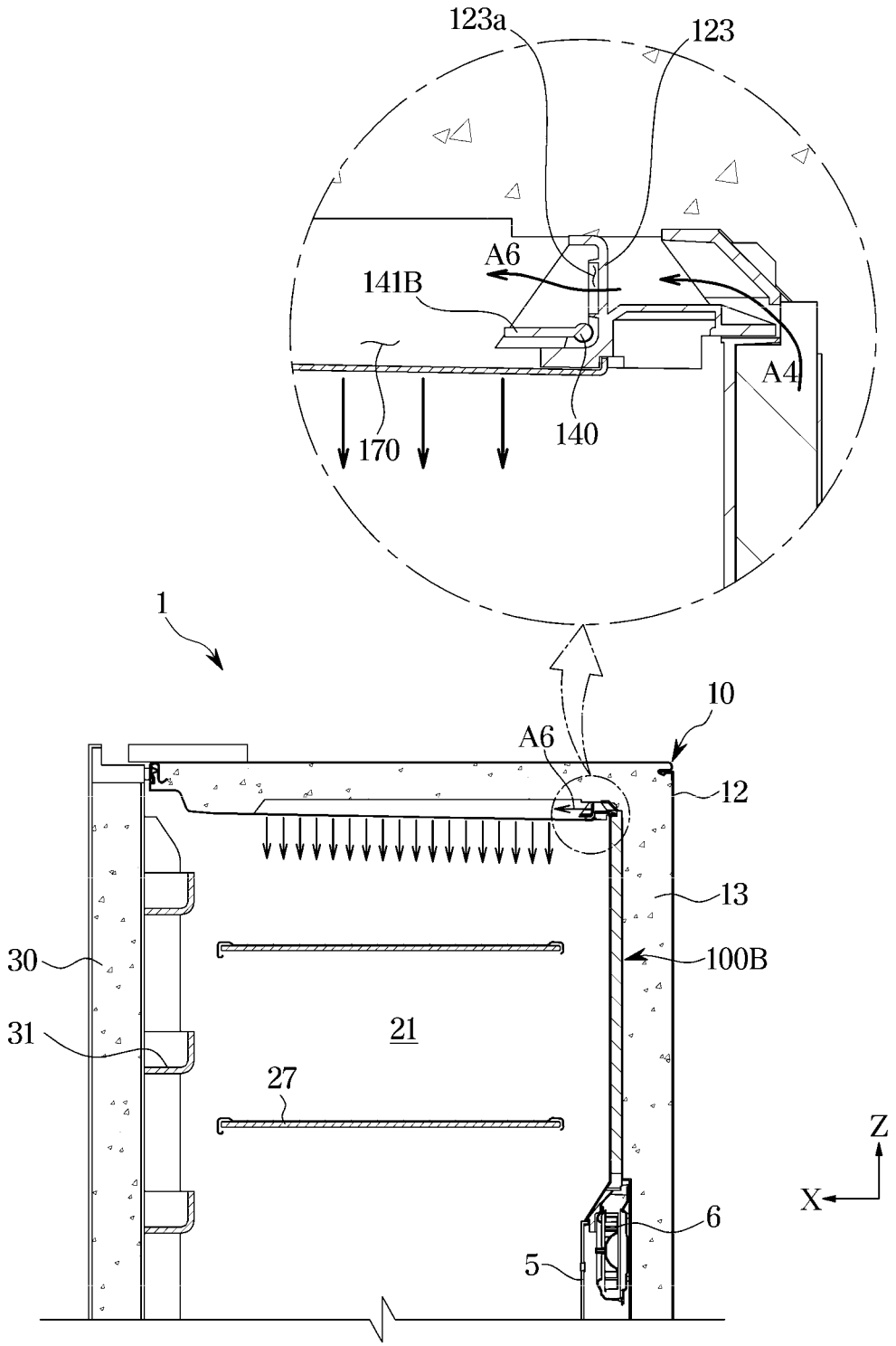
FIG. 11 illustrates a schematic side cross-sectional view of the refrigerator in which the damper of FIG. 9 is in a closed state.

FIG. 6 is an enlarged view illustrating a state in which a damper is in a closed state in the duct of FIG. 5, FIG. 7 is a view illustrating a rear surface of the duct of FIG. 6, FIG. 8 is a schematic side cross-sectional view of the refrigerator illustrating a state in which the damper of FIG. 6 is in a closed state, FIG. 9 is an enlarged view illustrating a state in which the damper is in an open state in the duct of FIG. 5, FIG. 10 is a view illustrating a rear surface of the duct of FIG. 9, and FIG. 11 is a schematic side cross-sectional view of the refrigerator illustrating a state in which the damper of FIG. 9 is in a closed state.

As illustrated in FIGS. 6 to 8, when the stopper 141 of the damper 140 is rotated to a closed position 141A for closing the second flow path inflow portion 123, the air in the duct 100 may be discharged into the storage compartment 21 through the first discharge port 111.

When the temperature of the inside of the storage compartment 21 exceeds a predetermined temperature, the controller (not shown) may control the damper 140 to allow the stopper 141 to be rotated so as to close the second flow inflow portion 123.

As the second flow path inflow portion 123 is closed, the air flowing through the main flow path 150 may flow to the first flow path 160 through the first flow path inflow portion 161 and then discharged to the storage compartment 21 through the first discharge port 111 provided on the first flow path 160.

At this time, the air in the duct 100 may flow at the rear side of the first surface 110, but may not flow to the upper side of the second surface 120 by the stopper 141.

That is, air flowing on the main flow path 150 (A1) may flow in an upward direction Z through the main flow path 150 formed along the first wall 112 extending in the up and down direction.

Air flowing to the upper side (A2) may not flow in a forward direction X by the stopper 141 but flow in the left and right direction Y, and then flow to the first flow path inflow portion 161.

Air flowing to the first flow path inflow portion 161 (A3) may flow along the first flow path 160 and then discharged to the storage compartment 21 through the first discharge port 111 provided on the first flow path 160.

As illustrated in FIGS. 9 to 11, when the stopper 141 of the damper 140 is rotated to an open position 141B for opening the second flow path inflow portion 123, the air in the duct 100 may be discharged into the storage compartment 21 through the second discharge port 131.

When the temperature of the inside of the storage compartment 21 drops to a predetermined temperature, the controller (not shown) may control the damper 140 to allow the stopper 141 to be rotated from the closed position 141A to the open position 141B.

When the stopper 141 is in the open position 141B, the second flow path inflow portion 123 may communicate with the main flow path 150. Accordingly, air flowing in the main flow path 150 may flow to the second flow path 170 through the second flow path inflow portion 123.

The air flowing on the main flow path 150 (A1) may flow into the second flow path inflow portion 123 (A4), and flow on the second flow path 170 (A6), and then discharged to the storage compartment 21 through the opening 121 and the plurality of second discharge ports 131.

Because the plurality of second discharge ports 131 has a fine discharge region, the speed of air discharged through the plurality of second discharge ports 131 may be less than the speed of air discharged from the first discharge port 111.

In addition, because the total discharge region of the plurality of second discharge ports 131 is greater than the discharge region of the first discharge ports 111, an amount of air discharged from the entire plurality of second discharge ports 131 may be greater an amount of air discharged from the first discharge port 111.

Accordingly, even when air is discharged at a low speed through the plurality of second discharge ports 131, the temperature of the inside of the storage compartment 21 may be maintained at an appropriate temperature.

The first flow path inflow portion 161 may be maintained in the open state without closing and thus some (A5) of the air flowing through the main flow path 150 (A1) may flow into the first flow path 160 and discharged to the storage compartment 21 through the first discharge port 111.

When most (A4) of the air flowing on the main flow path 150 (A1) flows into the second flow path 170 through the second flow path inflow portion 123 in a state in which the stopper 141 is in the open position 141B, the performance of the duct 100 may be increased.

The reason for discharging air through the plurality of second discharge ports 131 is to reduce the speed of the discharge air flow to improve the storage quality of food. In other words, although the temperature of the inside of the storage compartment 21 is an appropriate temperature, the storage quality of food may be reduced when air is discharged from the first discharge port 111 at a high speed.

As described above, in order to increase the amount of air flowing into the second flow path 170 when the damper 140 is open, an inflow area of the second flow path inflow portion 123 may be formed to be greater than an inflow area of the first flow path inflow portion 161.

Accordingly, a large amount (A4) of the air flowing in the main flow path 150 (A1) may flow to the second flow path inflow portion 123 having a large inflow area.

A small amount (A5) of the air flowing in the main flow path 150 (A1) may flow into the first flow path 160 and then flow into the first discharge port 111. However, the amount of air discharged through the second discharge port 131 is greater than the amount of air discharged through the first discharge port 111.

In addition, in order to reduce the amount of air flowing into the first flow path 160 when the damper 140 opens the second flow path 170, the first flow path 160 may be arranged on the outside of a direction, in which air flows on the main flow path 150.

That is, the main flow path 150 may be extended in the up and down direction Z and accordingly, the air flowing in the main flow path 150 may flow in the up and down direction Z. The first flow path 160 may be arranged on the outside in the left and right direction Y with respect to the up and down direction Z.

The second flow path 170 may be disposed on a traveling direction of air flowing in the main flow path 150 and thus a large amount of air flowing in the main flow path 150 may easily flow into the second flow path 170.

Because the duct 100 is provided in a shape extending from the rear surface 21*a* of the storage compartment 21 to the upper surface 21*b* and the blower fan 6 is disposed in the lower side of the duct 100, the air in the duct 100 may flow from the lower side to the upper side of the duct 100 and then flow to the front side.

The second flow path 170 may be disposed in the direction in which the air flows from the main flow path 150 because the second flow path 170 is disposed on the upper surface 21*b* of the storage compartment 21, as described above. Therefore, the air flowing in the main flow path 150 may flow to the second flow path 170 without relatively large resistance.

However, because the first flow path 160 is disposed on the outside of the direction, in which the air flows on the main flow path 150, as described above, the resistance may be generated when air flows through the first flow path 160. Accordingly, the amount of air flowing into the first flow path 160 may become less than the amount of air flowing into the second flow path 170.

In addition, because the total discharge region of the opening 121 and the plurality of second discharge ports 131 is greater than the discharge region of the first discharge port 111, the amount of air discharged through the plurality of second discharge ports 131 may be greater than the amount of air discharged through the first discharge port 111, and thus difference in air pressure may occur. Therefore, the amount of air flowing to the second flow path 170 may be greater than the amount of air flowing to the first flow path 160.

As described above, as needed, the duct 100 may discharge the air flowing on the main flow path 150 to the first discharge port 111 or the plurality of second discharge ports 131 to cool the storage compartment 21. Therefore, it is possible to increase the cooling speed of the storage compartment 21 and improve the storage quality of the food in the storage compartment 21.

That is, the duct 100 may selectively change the region, through which the air is discharged, by using the two flow paths 160 and 170 and the damper 140. Therefore, the duct 100 may regulate the amount and speed of air discharged to the storage compartment 21, as needed.

Hereinafter a duct 200 of the refrigerator 1 according to another embodiment of the disclosure will be described. Configurations other than a configuration of the duct 200 described below are the same as the configuration of the refrigerator 1 and the duct 100 according to an embodiment of the disclosure, and thus a description thereof is omitted.

Figure 12:
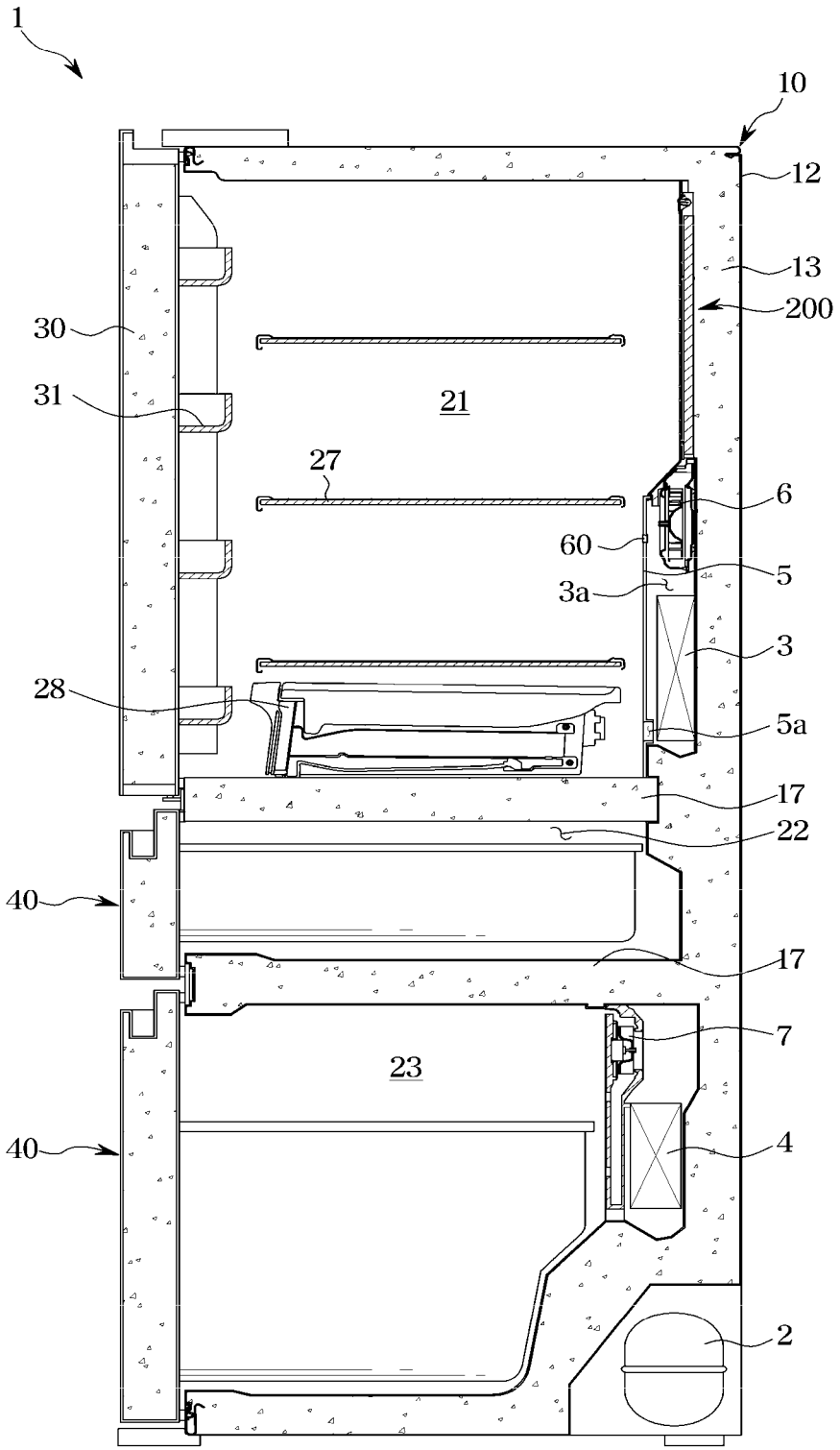
FIG. 12 illustrates a view of a refrigerator according to another embodiment of the disclosure.
Figure 13:
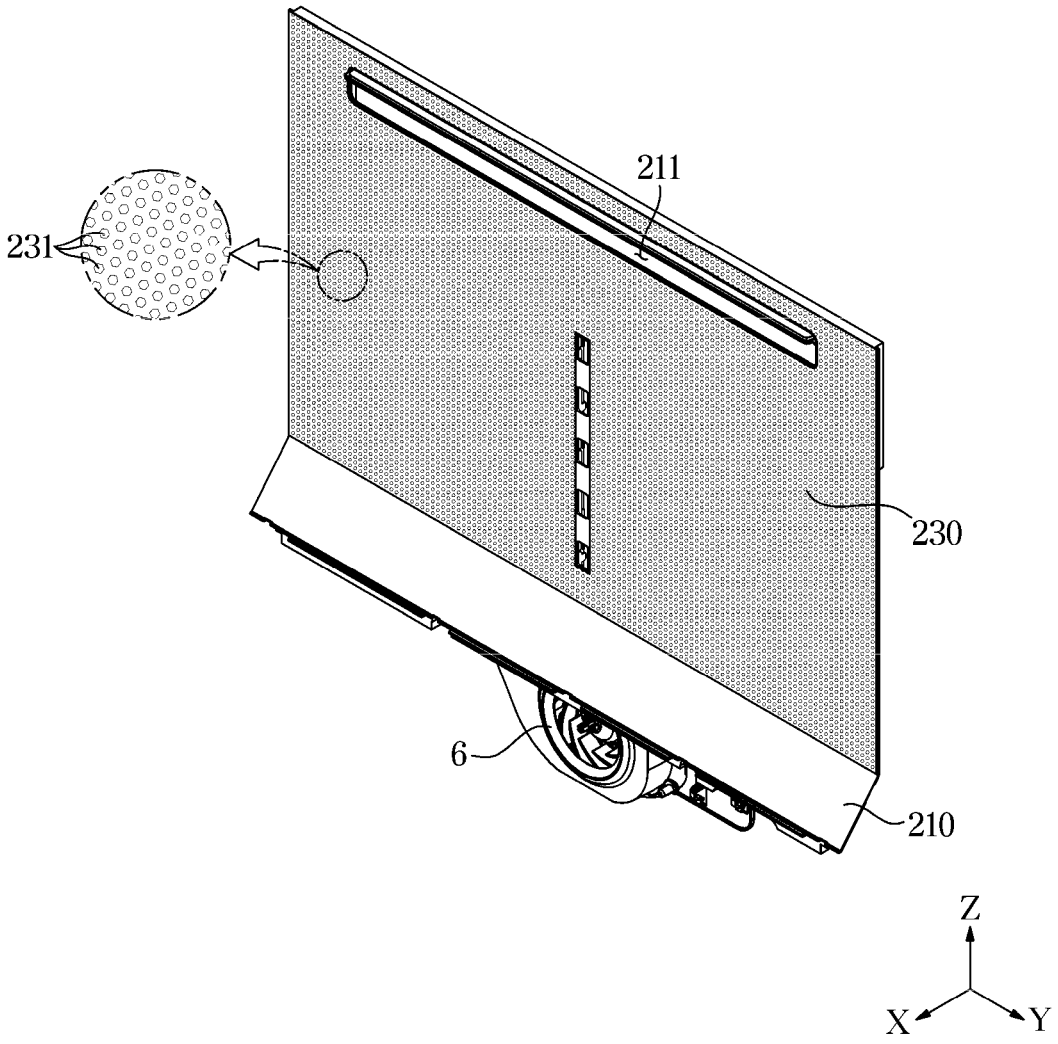
FIG. 13 illustrates a front perspective view of a duct of the refrigerator according to another embodiment of the disclosure.
Figure 14:
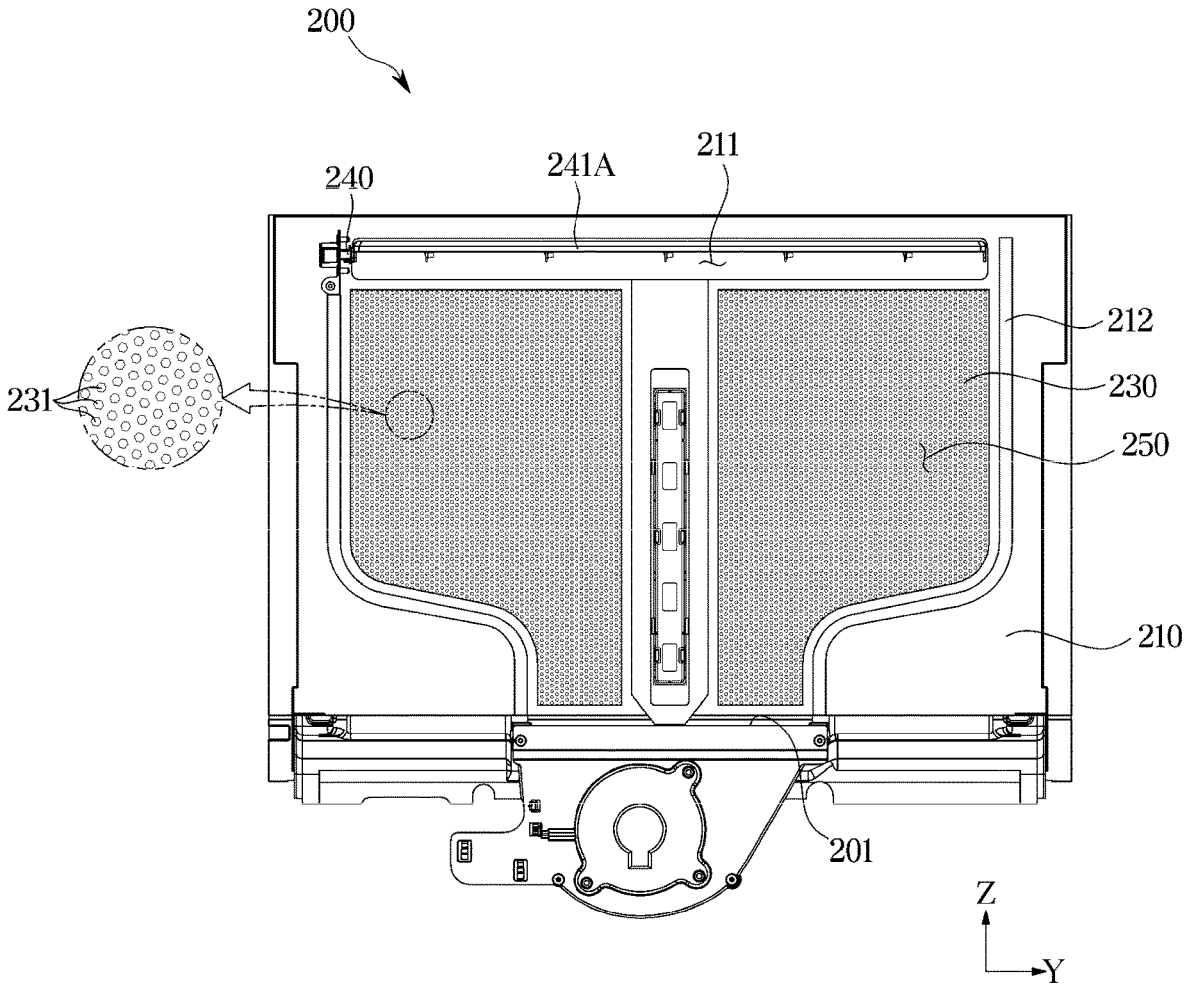
FIG. 14 illustrates a view of a rear surface of the duct of FIG. 13.

FIG. 12 is a view of a refrigerator according to another embodiment of the disclosure, FIG. 13 is a front perspective view of a duct of the refrigerator according to another embodiment of the disclosure, and FIG. 14 is a view illustrating a rear surface of the duct of FIG. 13.

As illustrated in FIGS. 12 to 14, the duct 200 may be disposed at a rear surface of a storage compartment 21.

The duct 200 includes a first surface 210, and the first surface 210 may form at least a part of the rear surface of the storage compartment 21.

The duct 200 may include a first discharge port 211 and a plurality of second discharge ports 231.

The first discharge port 211 may be disposed at an upper end portion of the first surface 210.

The first surface 210 may include an opening disposed below the first discharge port 211.

The duct 200 may include a discharge plate 230 in which the plurality of second discharge ports 231 is formed and configured to cover the opening of the first surface 210.

The discharge plate 230 may be provided to cover the opening of the first surface 210 in a front and rear direction X.

However, the disclosure is not limited to another embodiment, and the discharge plate 230 may be integrally formed with the first surface 210.

The duct 200 may include an inlet 201 through which air flows by a blower fan 6, and a flow path 250 provided to allow air flowing into the duct 200 to flow through the inlet 201.

The duct 200 may include a wall 212 configured to form the flow path 250. The wall 212 may be extended rearward from the first surface 210. The flow path 250 may be formed in a space surrounded by the wall 212.

The wall 212 may be extended approximately in the up and down direction. The wall 212 may be provided to be inclined with respect to the up and down direction or provided to have a curve so that a cross-sectional area of the flow path increases as the wall 212 becomes near to the upward direction Z.

The air flowing in the flow path 250 may be discharged to the first discharge port 211 or discharged to the plurality of second discharge ports 231 through the opening.

The duct 200 may include a damper 240 so as to guide the air in the duct 200 to be discharged to the first discharge port 211 or the second discharge port 131.

Particularly, the damper 240 may be configured to open and close the first discharge port 211.

When the damper 240 opens the first discharge port 211, air flowing in the flow path 250 may be discharged to the storage compartment 21 through the first discharge port 211. A small amount of the air may be discharged to the storage compartment 21 through the plurality of second discharge ports 231. This will be described later in detail.

When the damper 240 closes the first discharge port 211, air flowing in the flow path 250 may be discharged to the storage compartment 21 through the plurality of second discharge ports 231.

Hereinafter the flow of air in the duct 200 according to the opening and closing of the damper 240 will be described in detail.

Figure 15:
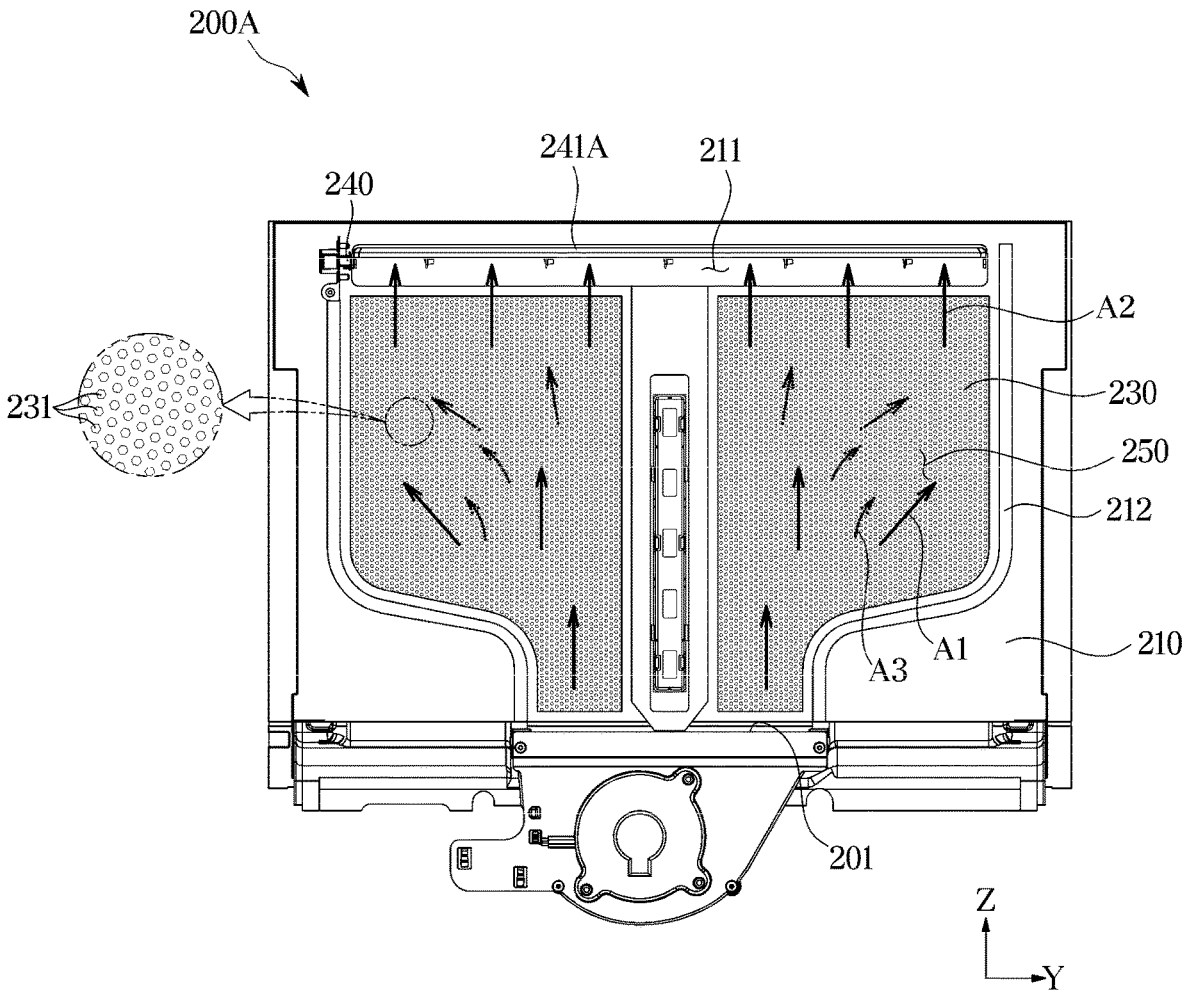
FIG. 15 illustrates a rear view of the duct in which the damper of the duct of FIG. 13 is in an open state.
Figure 16:
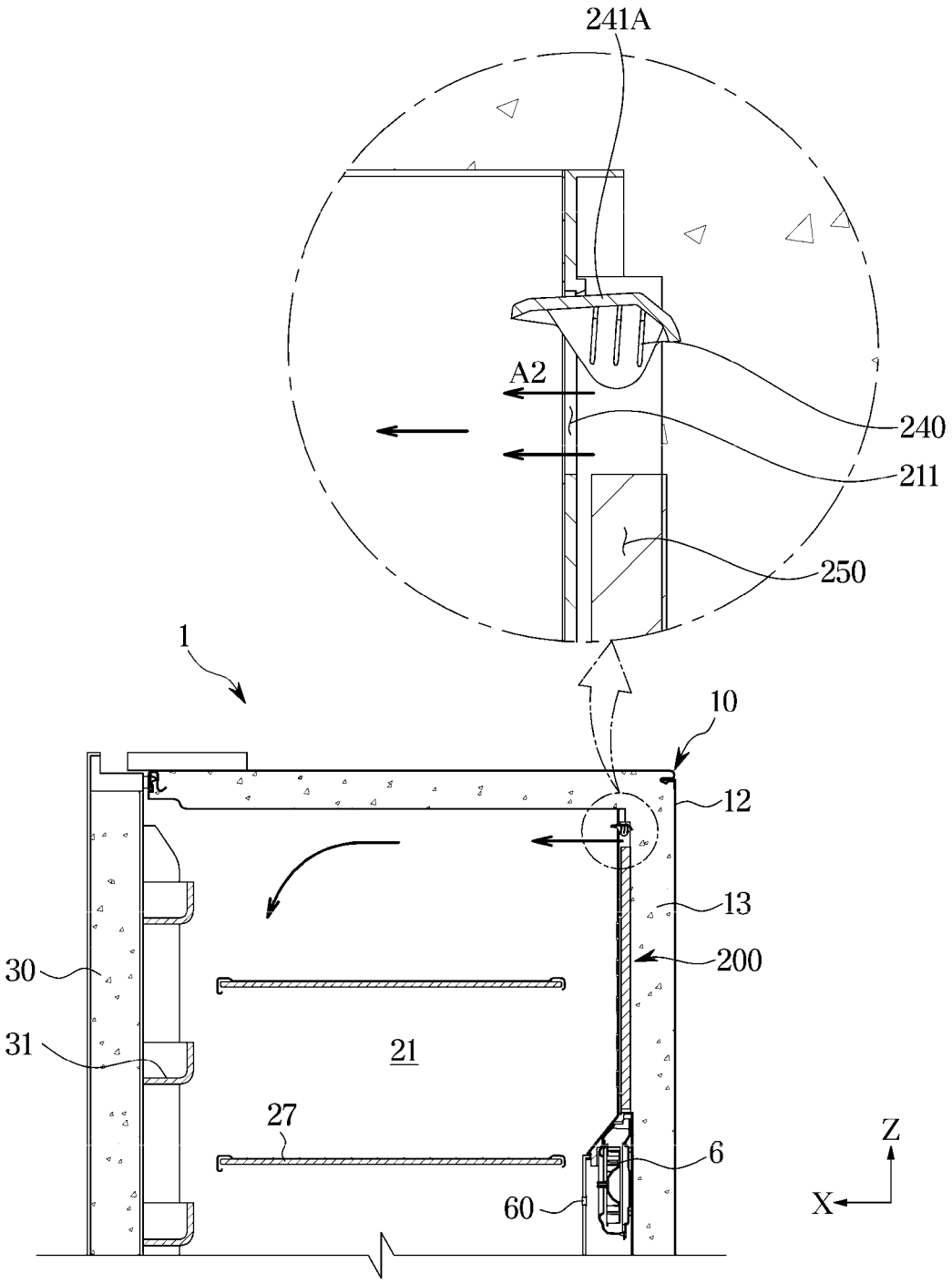
FIG. 16 illustrates a schematic side cross-sectional view of the refrigerator in which the damper of FIG. 15 is in an open state.
Figure 17:
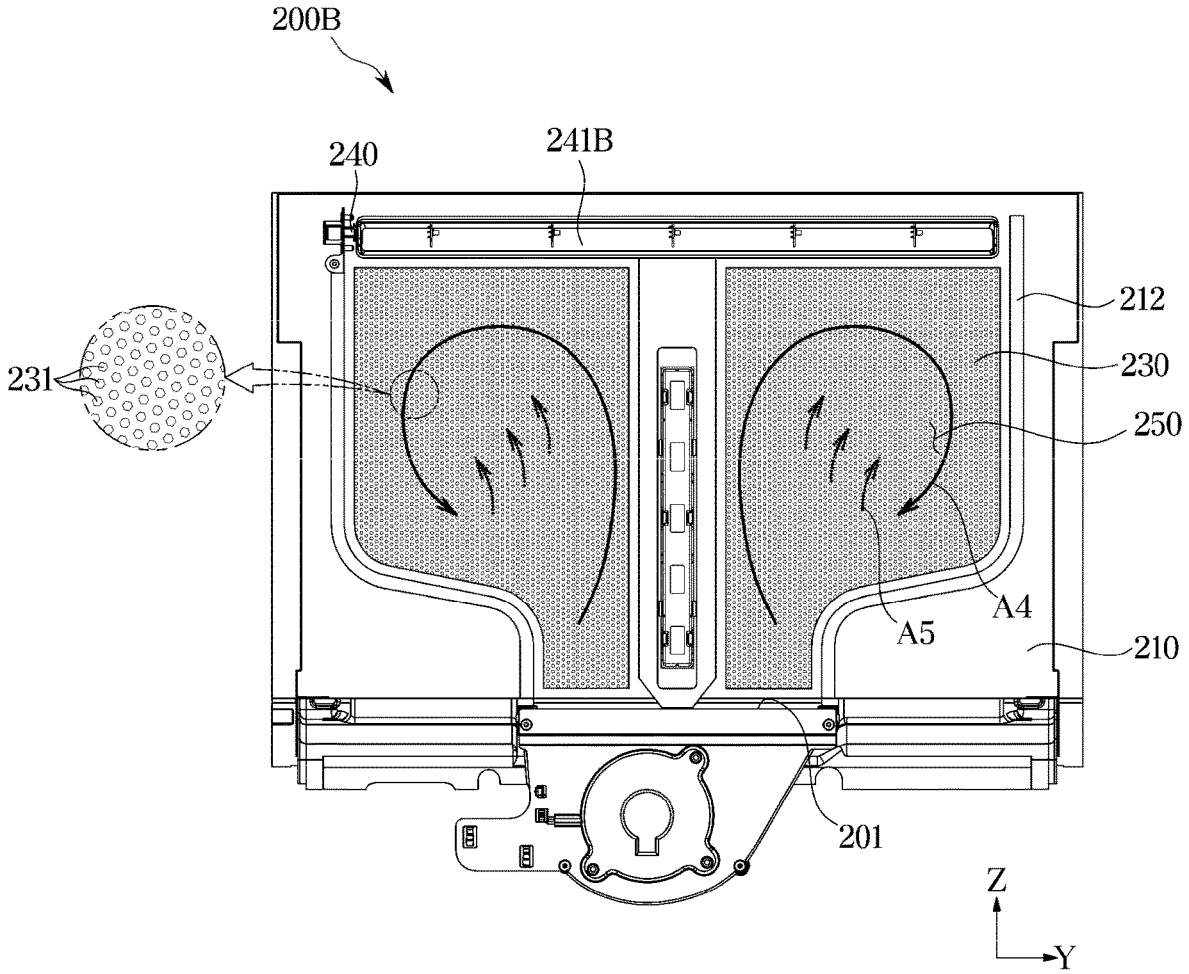
FIG. 17 illustrates a rear view of the duct in which the damper of the duct of FIG. 13 is in a closed state.
Figure 18:
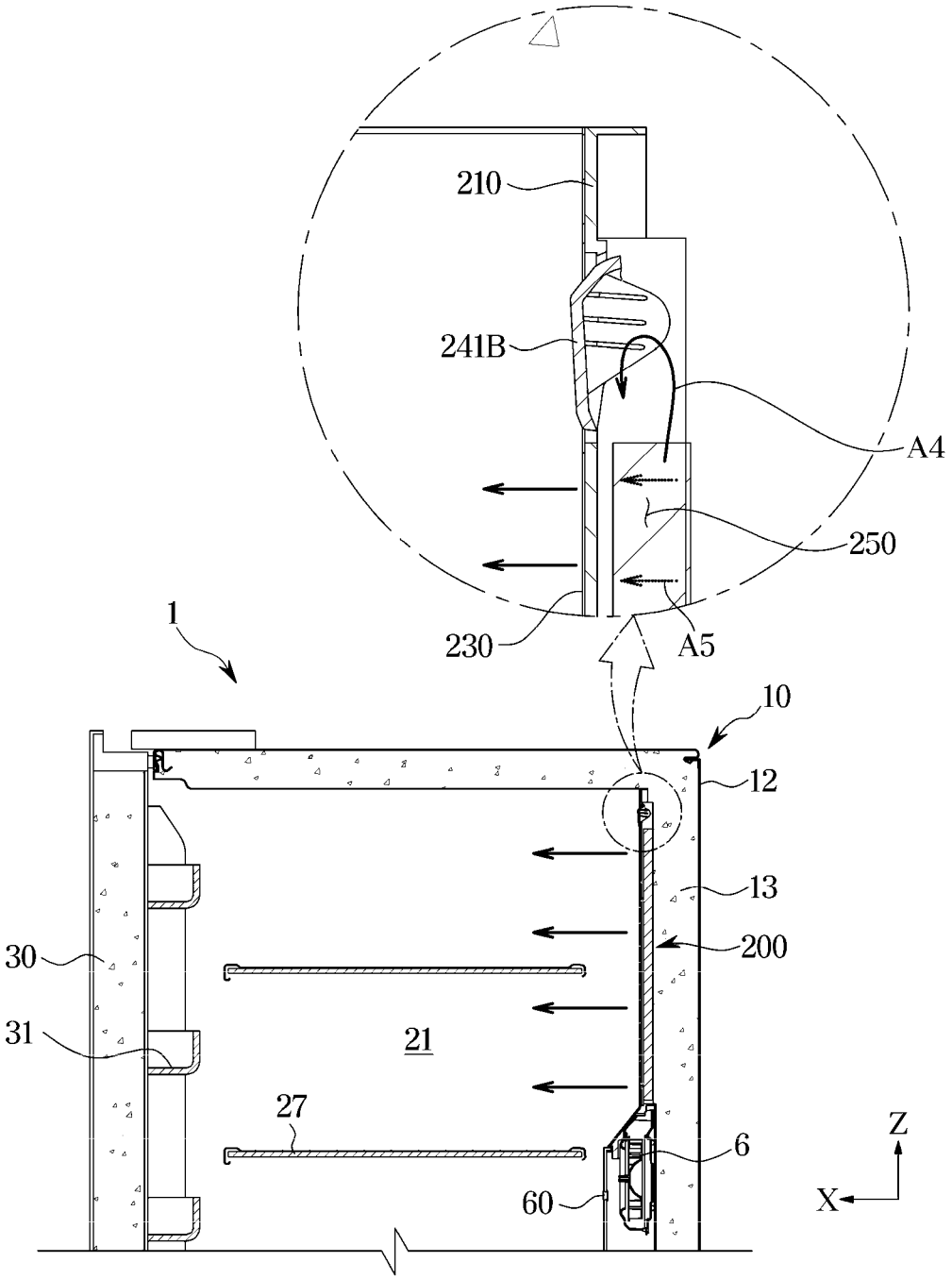
FIG. 18 illustrates a schematic side cross-sectional view of the refrigerator in which the damper of FIG. 17 is in a closed state.

FIG. 15 is a rear view of the duct illustrating a state in which the damper of the duct of FIG. 13 is in an open state, FIG. 16 is a schematic side cross-sectional view of the refrigerator illustrating a state in which the damper of FIG. 15 is in an open state, FIG. 17 is a rear view of the duct illustrating a state in which the damper of the duct of FIG. 13 is in a closed state, and FIG. 18 is a schematic side cross-sectional view of the refrigerator illustrating a state in which the damper of FIG. 17 is in a closed state.

As illustrated in FIGS. 15 and 16, when a stopper 241 of the damper 240 is rotated to an open position 241A for opening the first discharge port 211, air in the duct 200 may be discharged into the storage compartment 21 through the first discharge port 211.

At this time, because a discharge area of the first discharge port 211 is greater than a discharge area of each of the plurality of second discharge ports 231, the air may be discharged to the storage compartment 21 at a relatively high speed.

When the damper 240 opens the first discharge port 211, the duct 200 may be in a first state 200A of discharging air at a high speed.

The air, which flows into the flow path 250 through the inlet 201, may flow upward (A1) and discharged to the storage compartment 21 through the first discharge port 211 disposed on the upper side of the first surface 210 (A2).

When the air in the flow path 250 flows upward, a small amount of air (A3) may be discharged to the storage compartment 21 through the plurality of second discharge ports 231 formed on the flow path 250.

However, because the discharge region of each of the plurality of second discharge ports 231 is less than the discharge region of the first discharge port 211, as described above, a large amount of air flowing through the flow path (A1) may be discharged to the storage compartment 21 through the first discharge port 211(A2) due to the air pressure difference.

As illustrated in FIGS. 17 and 18, when the stopper 241 of the damper 240 is rotated to a closed position 241B for closing the first discharge port 211, air in the duct 200 may be discharged into the storage compartment 21 through the plurality of second discharge ports 231.

At this time, because the discharge area of each of the plurality of second discharge ports 231 is less than the discharge area of the first discharge port 211, the air may be discharged to the storage compartment 21 at a relatively low speed.

When the damper 240 closes the first discharge port 211, the duct 200 may be in a second state 200B of discharging air at a low speed.

The air flowing on the flow path 250 may flow upward but not be discharged by the stopper 241 and flow downward (A4) again and then be discharged to the storage compartment 21 through the plurality of second discharge ports 231.

Further, some of the air flowing in the flow path 250 may flow upward and then be directly discharged to the storage compartment 21 through the plurality of second discharge ports 231 (A5).

As is apparent from the above description, the duct of the refrigerator may selectively provide cold air to the storage compartment through the first discharge port and the plurality of fine second discharge ports. Therefore, the refrigerator may rapidly cool the inside of the storage compartment by supplying air through the first discharge port and may improve the storage quality of the food stored in the storage compartment by supplying air through the plurality of second discharge ports.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a body;

a storage compartment disposed inside the body;

an evaporator configured to generate cold air and disposed behind the storage compartment; and a duct configured to supply the cold air generated by the evaporator to the storage compartment, wherein the duct comprises:

a first surface configured to form at least a portion of the storage compartment, a second surface configured to form at least another portion of the storage compartment, at least one first discharge hole disposed at the first surface through which the cold air flowing in the duct is discharged, a plurality of second discharge holes through which the cold air is discharged at a speed lower than a speed of the cold air discharged through the at least one first discharge hole, and a damper configured to be movable between a first position and a second position, and selectively regulate a flow of the cold air to guide the cold air in the duct to the at least one first discharge hole or the plurality of second discharge holes, wherein the plurality of second discharge holes is arranged in a grid or matrix pattern including a plurality of rows and columns to be spread over an area of at least half of an area of the second surface, wherein an entire discharge area of the plurality of second discharge holes is larger than an entire discharge area of the at least one first discharge hole, and wherein the damper is configured to allow the cold air flowing in the duct to be discharged through the plurality of second discharge holes when the damper is in the first position, and the damper is configured to prevent the cold air flowing in the duct from being discharged through the plurality of second discharge holes when the damper is in the second position.

2. The refrigerator of claim 1, wherein a discharge area of each of the plurality of second discharge holes is less than a discharge area of the at least one first discharge hole.

3. The refrigerator of claim 1, wherein:

the duct comprises an opening configured to allow the cold air to flow into the plurality of second discharge holes, and the area of at least half of the area of the second surface is configured to cover the opening.

4. The refrigerator of claim 3, wherein an area of the opening is greater than the entire discharge area of the at least one first discharge hole.

5. The refrigerator of claim 1, the duct comprises a main flow path through which the air flowing into the duct flows, a first flow path through which the air flows from the main flow path to the at least one first discharge hole, and a second flow path through which the air flows from the main flow path to the plurality of second discharge holes, and an inflow area of an inflow portion of the second flow path is greater than an inflow area of an inflow portion of the first flow path.

6. The refrigerator of claim 5, wherein the damper is disposed in the inflow portion of the second flow path so as to open and close the inflow portion of the second flow path.

7. The refrigerator of claim 6, wherein the duct allows an amount of the cold air flowing into the second flow path to be greater than an amount of the cold air flowing into the first flow path when the damper opens the inflow portion of the second flow path.

8. The refrigerator of claim 6, wherein the duct allows the cold air to flow into only the first flow path when the damper closes the inflow portion of the second flow path.

9. The refrigerator of claim 5, wherein the at least one first discharge hole is arranged on a rear surface of the storage compartment and the plurality of second discharge holes is arranged on an upper surface of the storage compartment.

10. The refrigerator of claim 9, wherein:

the duct comprises a first wall configured to allow the main flow path and the first flow path to be separated from each other, and a second wall configured to form the first flow path together with the first wall, and the inflow portion of the first flow path is formed between one end of the first wall and one end of the second wall.

11. The refrigerator of claim 10, wherein the one end of the first wall and the one end of the second wall are provided to allow the inflow portion of the first flow path to be arranged on an outside of an air flow direction on the main flow path.

12. The refrigerator of claim 1, wherein the at least one first discharge hole and the plurality of second discharge holes are arranged on a rear surface of the storage compartment.

13. The refrigerator of claim 12, wherein the damper is configured to open and close the at least one first discharge hole.

14. The refrigerator of claim 12, wherein the at least one first discharge hole is disposed above the plurality of second discharge holes.

15. The refrigerator of claim 1, wherein a cross-sectional area of each of the plurality of second discharge holes is between approximately 0.05 $mm^2$ and approximately 5 $mm^2$.

16. A refrigerator comprising:

a body;

a storage compartment disposed inside the body;

an evaporator configured to generate cold air and disposed behind the storage compartment; and a duct configured to supply the cold air generated by the evaporator to the storage compartment, wherein the duct comprises:

a first surface configured to form at least a portion of the storage compartment, a second surface configured to form at least another portion of the storage compartment, a first discharge hole disposed at the first surface through which the cold air flowing in the duct is discharged, a plurality of second discharge holes disposed at the second surface, a main flow path through which the cold air flowing into the duct flows, a first flow path through which the cold air flows from the main flow path to the first discharge hole, a second flow path through which the cold air flows from the main flow path to the plurality of second discharge holes, and a damper configured to be movable between a first position and a second position, and guide the cold air flowing on the main flow path to the first flow path or the second flow path, wherein an inflow area of an inflow portion of the second flow path is greater than an inflow area of an inflow portion of the first flow path, wherein the plurality of second discharge holes is arranged in a grid or matrix pattern including a plurality of rows and columns to be spread over an area of at least half of an area of the second surface, wherein an entire discharge of the plurality of second discharge holes is larger than an entire discharge area of the first discharge hole, and wherein the damper is configured to guide the cold air flowing on the main flow path to the second flow path when the damper is in the first position, and the damper is configured to prevent the cold air flowing on the main flow path from flowing to the second flow path when the damper is in the second position.

17. The refrigerator of claim 16, wherein the first discharge hole is arranged on a rear surface of the storage compartment and the plurality of second discharge holes is arranged on an upper surface of the storage compartment.

18. The refrigerator of claim 17, wherein:

the duct comprises a first wall configured to allow the main flow path and the first flow path to be separated from each other, and a second wall configured to form the first flow path together with the first wall, and the inflow portion of the first flow path is formed between one end of the first wall and one end of the second wall.

19. The refrigerator of claim 16, wherein:

the duct comprises a discharge plate in which the plurality of second discharge holes is formed, one end of the second flow path is connected to the main flow path, and the other end of the second flow path comprises an opening provided to allow the cold air to flow into the plurality of second discharge holes, and the discharge plate is arranged on an upper surface of the storage compartment so as to cover the opening.

20. A refrigerator comprising:

a body;

a storage compartment disposed inside the body;

an evaporator configured to generate cold air and disposed behind the storage compartment; and a duct configured to supply the cold air generated by the evaporator to the storage compartment, and configured to be movable between a first position and a second position, wherein the duct comprises:

a first surface configured to form at least a portion of the storage compartment, a second surface configured to form at least another portion of the storage compartment, a first discharge hole disposed at the first surface through which the cold air flowing in the duct is discharged, a plurality of second discharge holes disposed at the second surface and having a cross-sectional area of between approximately 0.05 $mm^2$ and approximately 5 $mm^2$, and a damper configured to selectively regulate a flow of the cold air to guide the cold air in the duct to the first discharge hole or the plurality of second discharge holes, wherein the plurality of second discharge holes is arranged in a grid or matrix pattern including a plurality of rows and columns to be spread over an area of at least half of an area of the second surface, wherein an entire discharge area of the plurality of second discharge holes is larger than an entire discharge area of the first discharge hole, and wherein the damper is configured to allow the cold air flowing in the duct to be discharged through the plurality of second discharge holes when the damper is in the first position, and the damper is configured to prevent the cold air flowing in the duct from being discharged through the plurality of second discharge holes when the damper is in the second position.

* * * * *